United States Patent [19]

Stern et al.

[11] Patent Number: 4,709,858

[45] Date of Patent: Dec. 1, 1987

[54] DIGITAL FLOW CONTROL SYSTEM

[75] Inventors: Howard Stern, Greenlawn; Alex Mauro, Wheatley Heights; Jay Lee, Kings Park, all of N.Y.

[73] Assignee: Robotic Vision System, Inc., Hauppauge, N.Y.

[21] Appl. No.: 840,326

[22] Filed: Mar. 14, 1986

[51] Int. Cl.[4] ..... B05B 1/28

[52] U.S. Cl. ..... 239/296; 118/300; 118/674; 137/607; 137/601

[58] Field of Search ..... 137/599, 607, 601; 239/296, 178, 184, 188; 118/300, 674

[56] References Cited

U.S. PATENT DOCUMENTS

| | | | |
|---|---|---|---|
| 2,775,952 | 1/1957 | Schur | 118/300 X |
| 3,308,619 | 3/1967 | Richardson et al. | 137/599 X |
| 3,452,710 | 7/1969 | Hentschel | 118/674 |
| 3,830,256 | 8/1974 | Cox | 137/599 |
| 3,857,511 | 12/1974 | Gouindan | 239/296 X |
| 3,902,669 | 9/1975 | Keibler | 239/296 X |
| 3,905,394 | 9/1975 | Jerde | 137/599 |
| 4,517,917 | 5/1985 | Santefort | 118/300 X |
| 4,601,921 | 7/1986 | Lee | 118/300 X |

*Primary Examiner*—Martin P. Schwadron
*Assistant Examiner*—Stephen M. Hepperle
*Attorney, Agent, or Firm*—Max Fogiel

[57] ABSTRACT

An arrangement for controlling the flow of fluid in which the fluid is allowed to flow through a selected number of parallel paths of various flow capacities as determined by restricting orifices and cutoff valves. Accurate volume/length of fluid is dispensed at variable velocities by controlling both applicator velocity and flow rate. An arrangement is also provided for controlling the shape of the deposited fluid employing controlled air flow confinement.

1 Claim, 5 Drawing Figures

DIGITAL FLOW CONTROL SYSTEM

BACKGROUND OF THE INVENTION

In automating the application of sealant material it became necessary to accurately control the flow of material to accommodate variations in the velocity of movement of the applicator over the surface being sealed. Heretofore, no known devices were available to provide the desired function. Most systems that incorporated flow control were designed for constant flow rate.

Additionally, air under pressure can be directed at the stream of sealant being applied to a surface to control the shape of the bead profile. This is a very desirable control that a system may possess. Previous systems have controlled the bead profile without assistance of air pressure, by controlling the flow rate to be substantially constant and applying the sealant at a constant velocity. This method has the disadvantage of not enabling a controllcd variation of the bead profile

SUMMARY OF THE INVENTION

It is an object of the present invention to overcome the prior art disadvantages. In particular, it is the object of the present invention to provide an arrangement for automated sealant variable flow control and bead profile control.

In keeping with these objects, and with still others which will become apparent as the description proceeds, the important characteristics of the invention are: accuracy of control, rapid response and reliable operation.

In accordance with the present invention, sealant flow material enters an inlet manifold under essentially constant pressure. The manifold divides the input path into more than one path. Each path contains a fixed diameter orifice in its simplest form. A variable restrictor valve can be used if it is not desired to have a fixed control range.

Each path also contains provision for blocking flow that can be automatically controlled by, for example, electrical or pneumatic signals. The paths are then combined into a single output path by an outlet manifold. By making each orifice a different size, and in particular making the areas in a binary ratio sequence, a variety of flow rates can be obtained. For N paths with binary ratios, $2^N$ flow rates can be obtained.

Likewise, air flow may be controlled by a similar device and directed in a narrow beam at the sealant flow exiting from an applicator nozzle. By directing a beam of air at a controlled flow rate at the beam of sealant, the sealant beam is distorted to form the desired bead profile on the surface to which the sealant is being applied. Accurate control of the velocity at which the applicator nozzle is drawn across the surface, distance of the nozzle from the surface, orientation of the nozzle to the surface, sealant flow rate, air flow rate, sealant exit orifice cross section, sealant viscosity, and air exit orifice cross section are all essential to accurate bead profile control.

The invention will hereafter be described with reference to an exemplary embodiment, as illustrated in the drawings. However, it is to be understood that this embodiment is illustrated and described for the purpose of information only, and that nothing therein is to be considered limiting of any aspect of the invention.

DESCRIPTION OF PREFERRED EMBODIMENTS

Figure 1:
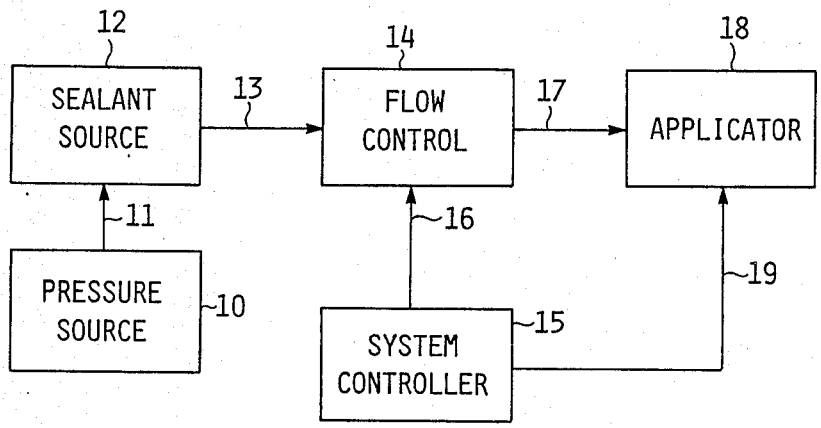
FIG. 1 shows a block diagram of the flow control system, in accordance with the present invention.

In FIG. 1, a source of sealant 12 is shown although the system is applicable to flow control of other fluids, in either liquid or gas form. An arrangement of applying pressure 10 via coupling 11 to the sealant within source 12, forces the sealant through conduit 13 and into a flow control device 14. A system controller 15 supplies control signal 16 to device 14 to vary the flow through conduit 17 in proportion to the velocity of applicator 18 over the surface upon which applicator 18 is directed to apply the sealant via control signal 19. Thus, system controller 15 is able to vary applicator 18 velocity to obtain maximum production rates and adjust the sealant flowing through the applicator 18 to maintain a desired sealant bead size (volume/length). Alternately, a measurement of velocity could be obtained by controller 15 to adjust the flow rate to applicator 18. Likewise, controller 15 may vary pressure supplied by source 10 or obtain a measure of source pressure to provide greater control and/or system flexibility.

Figure 2:
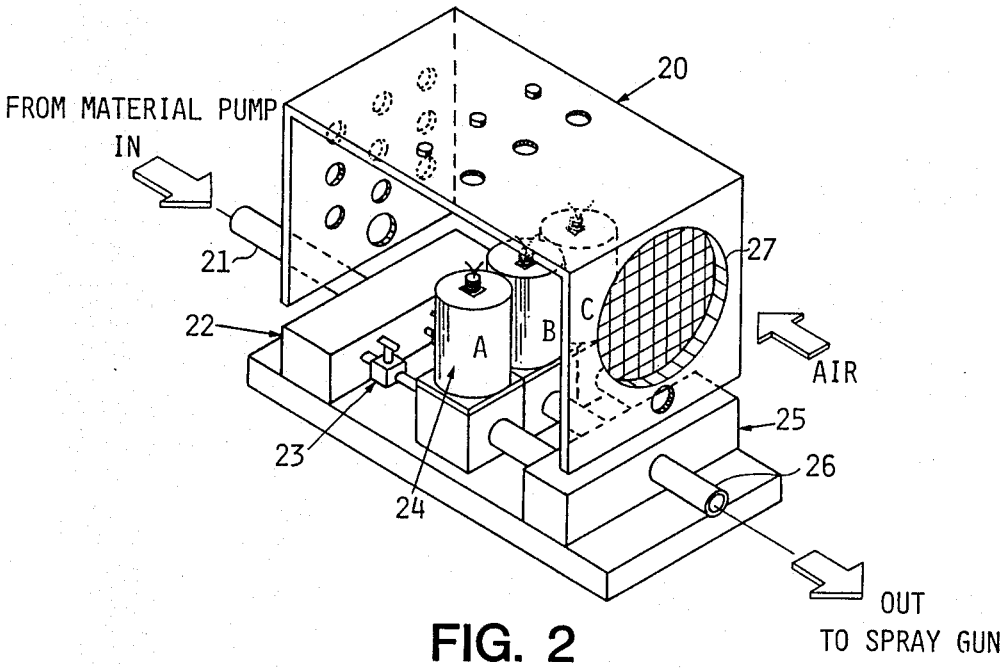
FIG. 2 illustrates the implementation of a digital flow control device.

FIG. 2 shows the flow control device 14 in detail. Sealant material enters via conduit 21 into inlet manifold 22 where the material splits among several paths. Each path contains restrictor valve 23 which may be adjustable for flexibility or may be a fixed orifice diameter for low cost and high reliability. A controllable valve 24 such as a pneumatic or solenoid operated valve allows flow to take place, or blocks flow in each path on command of a controlling mechanism. The flow through each unblocked path is combined by outlet manifold 25 into output conduit 26.

Cover 20 with an opening 27 can be attached to direct cooling air, if needed, over controlling solenoids 24.

Figure 3:
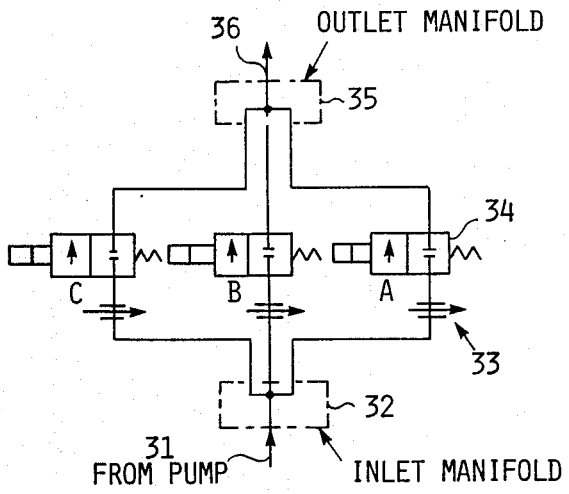
FIG. 3 is a schematic diagram of the digital flow control device.

FIG. 3 provides a schematic representation of the flow control device 14 (FIG. 1). Fluid under essentially constant pressure enters inlet manifold 32 via conduit 31 and, for illustration of the principle, is divided into three paths. Each path contains a restricting orifice 33, either fixed or variable, and a controlled valve 34 e.g., a solenoid. An outlet manifold 35 combines the fluid flowing out of the paths into conduit 36. If the restrictors 33 in the paths are chosen to limit flow rates in their respective paths in the ratios 1:2:4, then eight flow rates from 0 to 7 units of volume per unit time may be selected in roughly equal increments, by using the well known binary sequence.

The accuracy or linearity of the division of flow rate can be improved by maintaining a large pressure differential between the inlet manifold 32 and outlet manifold 35. Non-linearity can be attributed to the back pressure formed in outlet manifold 35 as additional flow paths are opened via solenoid valves 34.

Figure 4:
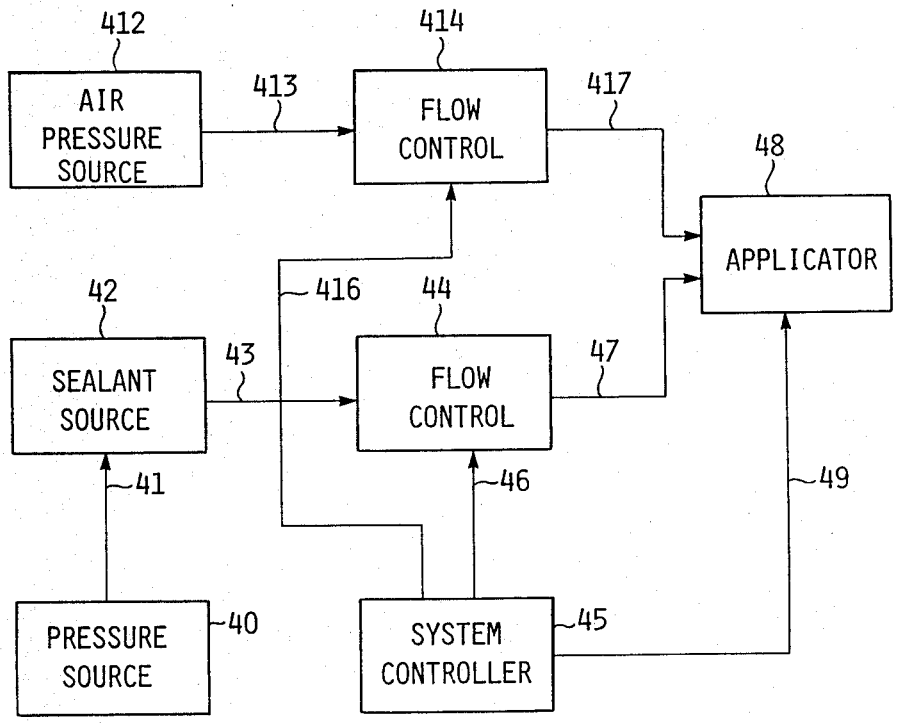
FIG. 4 is a schematic diagram of the use of digital flow control devices to regulate the flow of air and sealant in an air-assisted sealant application.

The method of controlling volume/length of sealant bead size has so far been described. FIG. 4 shows how air-assisted sealant application may be implemented to include the capability of shape control. The sealant flow control portion of FIG. 4, made up of pressure source 40, sealant source 42, and flow control 44, are the same as corresponding elements in FIG. 1. Applicator 48 differs from applicator 18 in that orifices are added from which air streams are emitted to force the sealant into a desired bead profile. Air pressure source 412 forces air through conduit 413 to a flow control mechanism 414 which may be of the form shown in FIG. 3. The air enters manifold 32 at high pressure and the pressure is reduced by restricting orifices 33 in paths containing an open solenoid valve 34. Air flowing through open paths is combined by outlet manifold 35 into conduit 417. The air pressure in conduit 417 is, therefore, approximately equal to the sum of the pressures of the open solenoid valve paths as controlled by a portion of the control logic within system controller 45 via control signal 416. Another portion of the control logic controls the Sealant flow through conduit 47 via control signal 46.

Figure 5:
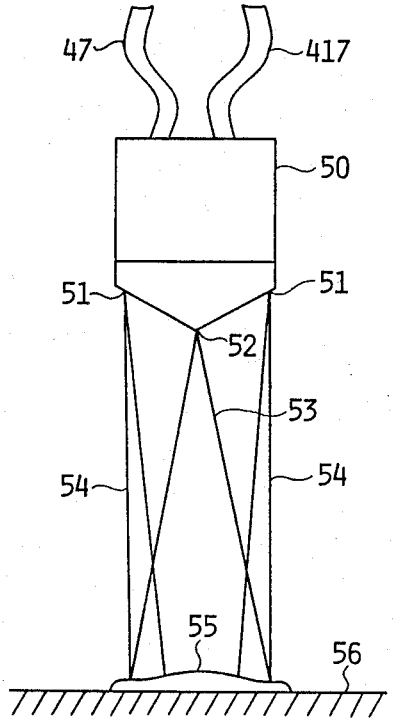
FIG. 5 is a cross section of a sealant spray nozzle employing air orifices for bead profile control.

FIG. 5 provides a cross-sectional view of a possible implementation of a sealant nozzle 50 used as part of applicator 48. Applicator 48 may consist of a robot carrying nozzle 50 with air supply conduit 417 and sealant supply conduit 47. Sealant is sprayed from orifice 52 toward surface 56 via path 53. Air is emitted in concentrated streams 54 from orifices 51 aimed to keep the sealant bead 55 from spreading more than a desired amount. Control signal 49 directs the robot to carry nozzle 50 along the path that bead 55 is required to take.

The invention has been described and illustrated with reference to an exemplary embodiment. It is not to be considered limited thereto, inasmuch as all modifications and variations which might offer themselves are intended to be encompassed with the scope of the appended claims.

What is claimed is:

1. An arrangement for enabling air-assisted fluid material deposition shape control, comprising: a source of fluid for deposition supplied at predetermined pressure; an inlet manifold for dividing incoming fluid into at least two paths; a restricting orifice in each said path for setting a predetermined flow rate in said path; a controllable valve in each said path for transmitting flow or blocking flow of said fluid; an outlet manifold for combining said fluid from each said path into an output conduit; applicating means having a central orifice for material deposition and at least one air stream orifice located lateral to said central orifice with respect to intended direction of travel during material deposition; said applicating means forming a fluid bead profile of predetermined size and shape; a source of air supplied at predetermined pressure; an inlet manifold for dividing incoming air into at least two air paths; an air restricting orifice in each said air path for setting a predetermined flow rate in said air path; a controllable valve in each said air path for transmitting flow or blocking flow of said air; and outlet manifold for combining said air from each said path into an output conduit; and a system controller for controlling the flow rate of said fluid and the flow rate of said air to said applicating means, directed flow of said air controlling shape and size of said fluid bead profile emitted from said applicating means, said air being emitted from said air restricting orifices in substantially concentrated streams to prevent said fluid bead from spreading more than a predetermined amount.

* * * * *